US006443783B1

(12) United States Patent
Beadle

(10) Patent No.: US 6,443,783 B1
(45) Date of Patent: Sep. 3, 2002

(54) ELECTRICAL TERMINAL CONNECTOR

(76) Inventor: Joshua Beadle, 5362 Caminito Vista Lujo, San Diego, CA (US) 92130

( * ) Notice: Subject to any disclaimer, the term of this patent is extended or adjusted under 35 U.S.C. 154(b) by 0 days.

(21) Appl. No.: 09/504,698

(22) Filed: Feb. 16, 2000

(51) Int. Cl.[7] ..... H01R 4/36
(52) U.S. Cl. ..... 439/814; 439/718; 439/908
(58) Field of Search ..... 439/709, 718, 439/814, 810, 908; 361/823; 336/192

(56) References Cited

U.S. PATENT DOCUMENTS

| | | | | | |
|---|---|---|---|---|---|
| 497,732 | A | * | 5/1893 | Stupakoff | 439/814 |
| 582,464 | A | * | 11/1897 | Dusenbury | |
| 2,671,888 | A | * | 3/1954 | Hadden et al. | |
| 2,920,305 | A | * | 1/1960 | Gibson et al. | |
| 2,984,818 | A | * | 3/1961 | Logan | |
| 4,070,086 | A | * | 1/1978 | Trafford | |
| 4,120,555 | A | * | 10/1978 | Shiflett | |
| 4,415,044 | A | * | 11/1983 | Davis | 439/718 |
| 5,957,733 | A | * | 9/1999 | Mello et al. | 439/814 |
| 6,176,747 | B1 | * | 1/2001 | Rowe et al. | 439/721 |

OTHER PUBLICATIONS

FX Luminaire, Installation Instructions, PowerX Transformer, 1998, Eight Pages (total), PX R4–98, USA.

* cited by examiner

*Primary Examiner*—Neil Abrams
(74) *Attorney, Agent, or Firm*—Eleanor M. Musick; Kilpatrick Stockton LLP

(57) ABSTRACT

The transformer box connector comprises a plurality of terminal blocks and a terminal block retainer with a hinged cover mounted on a housing. The terminal block retainer has a plurality of insulating ribs that act as partitions. Terminal blocks for receiving at least one electrical wire are mounted within the spaces between each insulating rib. Each terminal block is mounted to the terminal block retainer by a planar member that extends from its base. A fastening member, which provides an electrical connection from the wire secured in the terminal blocks to the transformer, extends from the planar member and can be configured as a fastening screw or a fastening post. The fastening member provides means for attaching the terminal block to the terminal block retainer and to the transformer housing. The hinged cover may include openings for access to set screws in the terminal blocks.

23 Claims, 2 Drawing Sheets

ELECTRICAL TERMINAL CONNECTOR

FIELD OF THE INVENTION

The invention relates to a connector assembly for a transformer box for providing power to multiple output devices and more specifically to a transformer box having connection blocks to facilitate connections with improved safety and accessibility.

BACKGROUND OF THE INVENTION

Environmental lighting systems typically operate by providing low voltage to a number of lamps which are located to enhance various features in the environment, such as statues or trees, or to illuminate walkways for safety. The low voltage, usually 12 volts, is produced by one or more transformers that are connected to a 120 VAC source and positioned within the area covered by the lighting system in a way to ensure a supply of consistent, stable voltage levels as well as to operate efficiently. An important consideration when designing a lighting system is light output and lamp life, both of which are optimum when each lamp is operated within a relatively narrow range, e.g., 10.5 to 11.5 volts. Because the light fixtures are usually positioned at different distances from the transformer box with differing numbers of fixtures on different cables, the voltage requirements for any given cable may differ. Cables to lamps at the greatest distance from the transformer and/or having a greater quantity of lamps will require an initially higher output voltage and/or a heavier gauge of cable to compensate for voltage drop over long stretches of cable and multiple lamps The physical size of the cable on the 12 volt secondary side can become very large when a cable runs requires a high wattage load, such as down a long path or driveway. Basic electrical theory dictates that the cable conductors on the 12 volt side of the transformer will be much larger than the conductors on the 120 volt primary side. In order to reduce the supply voltage down to a safe 12 volts, the amperage must be increased by a factor of ten. In theory, the cable gauge to carry 300 watts at 12 volts (25 amps) should be 10 times the thickness of the cable from the 120 volt source (2.5 amps.) To correctly account for this relationship, the low voltage connector in a terminal box should be able to accommodate large gauge cables. In conventional outdoor lighting systems, however, this is not the case, and the available connectors do not provide adequate physical openings to securely receive large gauge cables. Another consideration in the lighting system design is centering of the wattage load in order to minimize cable runs, also to avoid excessive voltage drops for efficient use of the supply voltage.

Most existing transformer boxes were designed and built for an industrial purpose. Although the basic functionality of a transformer box has not changed for many years, there is now a heightened awareness of particular safety and visual accessibility issues that exist when they are used in a public, commercial, or residential setting, such as in environmental lighting systems. An aspect of environmental lighting systems that creates a particular safety issue is the aforementioned need to center the transformer within a lighting zone for balanced distribution of power. This means that the transformer may be located in position that is not as easily secured as might be, for example, a service cabinet or closet on one side of a building, or a garage. Thus, while efforts are usually made to locate the transformer inconspicuously, outside of direct view, they may, nonetheless, be accessible to individuals, including children. Thus, it is important to ensure that wires leading to and from the transformer be firmly secured.

Lighting systems are typically installed by professional installers who will need ready access to the transformer's interior connection points. In existing systems, these connection points are plastic conduit sleeves into which the bare cable wire is inserted and held in place by a flat-top set screw. Set screws are located within a covering made of plastic or other insulating material to prevent inadvertent contact with metal which may be conducting electricity. In a typical low voltage lighting installation, there are several field cables running into a single terminal connection. It can be difficult for the installer to insert the largegauge, oftentimes stiff wires into the narrow openings. Further, the set screws, which are fairly small, are recessed within the protective material, so the screwdriver must be inserted into an opening in the plastic, making clear visual confirmation of the connection difficult. Most terminal connectors are of a blindtype which do no allow the installer to visually confirm the connection by seeing the conductors pass under the set screws. Without a solid connection, arcing and overheating can occur. Although the voltage may be low, the current can be as high as 50 amps. Loose or inadequate metal-to-metal connection with the field wire can be particularly hazardous since the circuit protection in the transformer or main house circuit breaker will not detect an overheated terminal connection because it does not cause a short or an excessive amperage to trip the breaker.

Since the installer is generally well-versed in safe handling of electrical conductors, and since he or she will be doing most of the installation with the system disconnected from a live voltage supply, safety concerns are not as much of an issue as they might be for the uninitiated homeowner or curious child after the lighting system is operational. Thus, the installer may consider the conventional safety features to be obstacles to making secure connections. Regardless of inconvenience to the installer, safety precautions must be taken to avoid accidental electric shock once the 120 VAC is connected.

For the reasons described above, there remains a need for a transformer box construction that allows for easy and secure connection of a lighting system in the smallest-possible physical size enclosure while providing protection against electrical shock for untrained persons who may intentionally or unintentionally gain access to the interior of the transformer box.

SUMMARY OF THE INVENTION

It is an advantage of the present invention to provide a transformer box connector that allows for easy and secure insertion of electrical wires.

It is a further advantage of the present invention to provide a transformer box connector with a hinged cover that protects against direct contact with bare wire or an exposed connector after the system is operational, thereby helping to limit the possibility of severe injury from electrical shock.

Another advantage of the present invention is to provide a transformer box connector that is safe, compact, and simple-to-use.

Yet another advantage of the present invention is to provide a terminal connector that provides means for visual confirmation of a connection.

In an exemplary embodiment, the transformer box connector is encased within a transformer box. The transformer box has a hinged door and an interior volume for retaining a transformer housing. A transformer and other components can be located underneath the housing. The hinged door includes a lip which attaches to the latching mechanism mounted on the side of the transformer box for securing the hinged door. The transformer box will preferably be made of a stainless steal or other similar material so the transformer box will be protected from outside elements. The transformer box is supplied standard household power of 120 VAC via an electrical cable or power cord.

In an exemplary embodiment, the transformer box connector comprises a terminal block retainer mounted on a housing located in the interior of the transformer box. The terminal block retainer has a hinged cover that is pivotally attached at the rear corners of the terminal block retainer. The hinged cover can be lifted and slide downward from the top of the rear corners so that the hinged cover will be locked into place. The hinged cover includes a plurality of openings in its top to allow a screwdriver or fastening device easy access to tighten the setscrew without lifting the hinged cover, thereby eliminating direct contact with an electrically hot wire or connector. The hinged cover will preferably have a plurality of slots or openings in the sides or front corners to allow fastening screws to restrict movement of the hinged cover for additional safety measures.

The terminal block retainer has a plurality of insulating ribs or partitions. Within each insulating rib of the terminal block retainer, a generally cube-shaped terminal block is mounted to provide for insertion of electrical wires. The insulating ribs separate each terminal block from the other to electrically isolate each connection. The insulating ribs also guard against inadvertent contact with one terminal block when inserting or removing a wire at a neighboring block.

Each terminal block is preferably formed from a die cast aluminum or other similar material, but may be machined or molded. Each terminal block has a front face and a top, both having bores formed therethrough which intersect within the block. The front face bore can be formed as a circle, but is preferably off-circular to provide a large diameter opening near the bottom of the block to facilitate insertion of wires. The top bore is internally threaded from the top, preferably all the way to the bottom of the hollow interior of the block. A setscrew is screwed into the top bore for locking wires in place after insertion into the front face bore. In the preferred embodiment, the top to bottom threading of the top bore allows for the setscrew to be adjusted in accommodating from a single thin wire to a bundle of heavy gauge wires.

Each terminal block is mounted to the terminal block retainer by a planar member that is formed at its base and extends horizontally therefrom. A fastening member attaches to the planar member. The fastening member can be configured as a fastening screw or a threaded fastening post, and is formed from a conductive material to provide an electrical conduction path from the terminal block to the transformer taps. The fastening screw or post is inserted through the terminal block retainer and an opening in the housing opening, and is secured at its end by a receiving nut once other connections have been completed.

In an exemplary implementation, an electrical wire from a transformer tap is attached to the fastening member by a round washer crimp or a similar fastening means. The round washer crimp, which attaches to the end of the electrical wire, has a washer portion with a diameter adapted to fit over the fastening member. The washer portion of the hround washer crimp is slid onto the end of fastening member and upward until the top portion is butted against the circular shaft of the terminal block retainer. The round washer crimp is secured in place by the receiving nut so that the round washer crimp and the electrical wire is secured between the circular shaft and the receiving nut.

In alternate embodiment, a pair (or more) of retaining sleeves can be used to secure the housing against the terminal block retainer. A retaining sleeve is inserted over the fastening member and the circular shaft of the terminal block retainer on at least one shaft location on either side of a centerline bisecting the terminal block retainer. The retaining sleeves provides upward force against the upper face of the housing to ensure a tight fit between the terminal block retainer and the housing. The receiving nut provides for securing the retaining sleeves in place.

BRIEF DESCRIPTION OF THE DRAWINGS

Understanding of the present invention will be facilitated by consideration of the following detailed description of a preferred embodiment of the present invention taken in conjunction with the accompanying drawings, in which like numerals refer to like parts and in which.

DETAILED DESCRIPTION OF THE INVENTION

Figure 1:
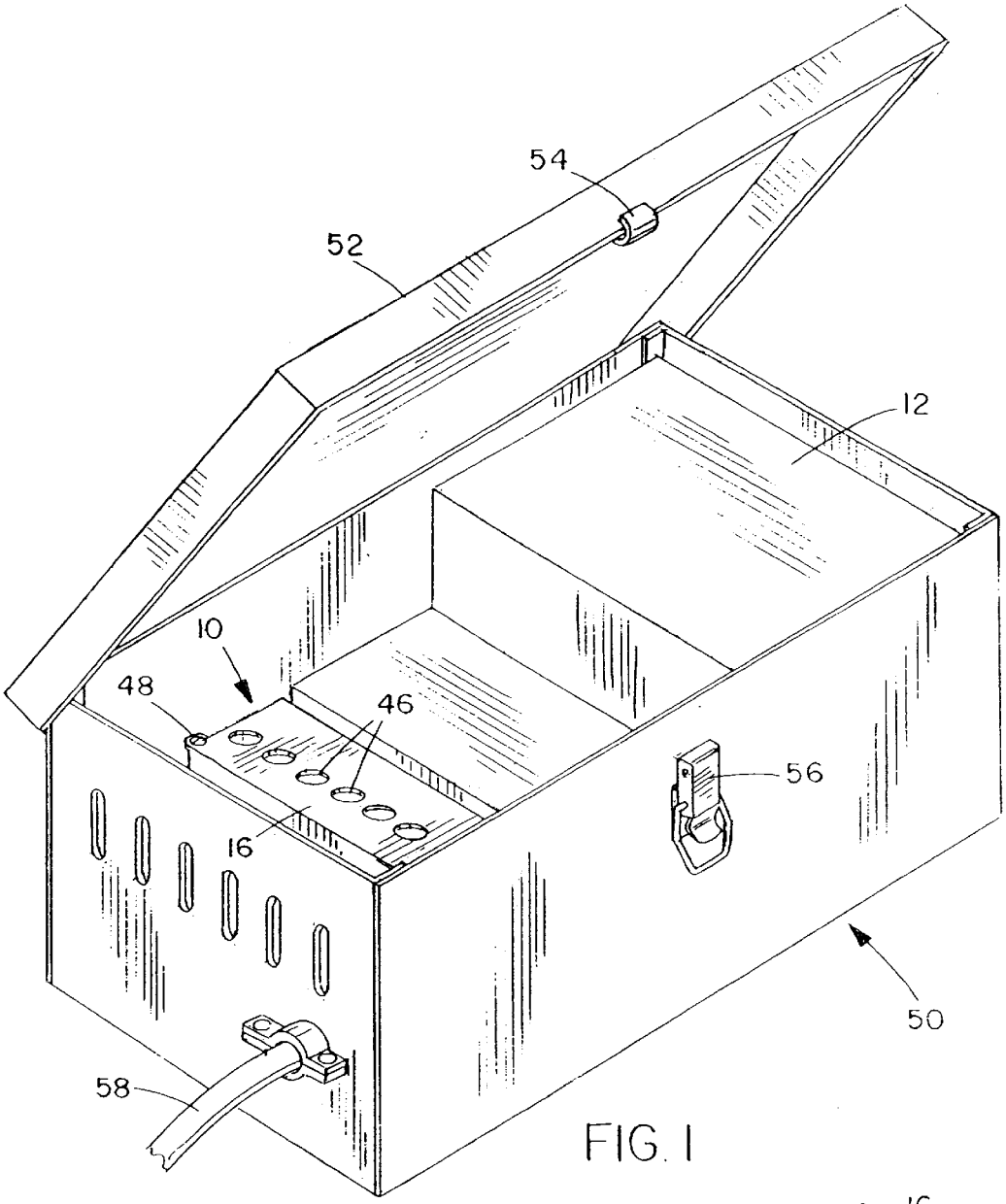
FIG. 1 is a perspective view of a transformer box containing the transformer box connector.

As illustrated in FIG. 1, the transformer box connector 10 is encased within a transformer box 50. The transformer box 50 has a hinged door 52 and an interior recess for a housing 12. A transformer and other components can be located underneath the housing 12. The hinged door 52 includes a lip 54 which attaches to the latching mechanism 56 mounted on the side of the transformer box 50 for securing the hinged door 52. The transformer box 50 will preferably be made of a stainless steel or other similar material so the transformer box 50 will resist corrosion when installed at an outdoor location. The transformer box 50 is connected to a standard household power supply (120 VAC) by the electrical power cord 58 or other appropriate cable connection. Additional components and circuitry for providing stepped-down voltage using the 120 VAC supply are well known to those of skill in the art and, therefore, are not described herein.

Figure 5:
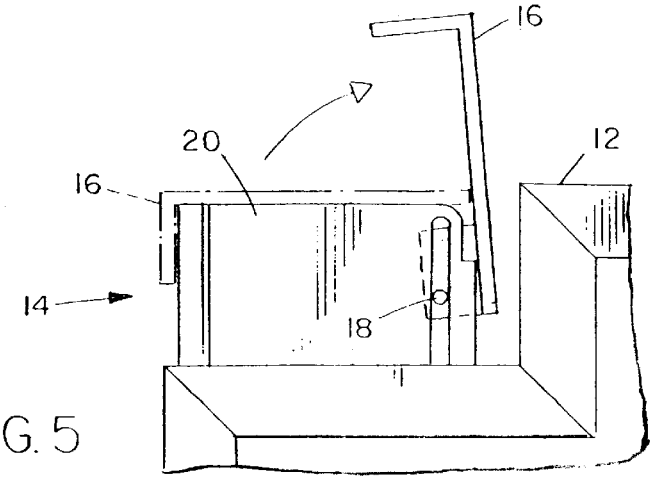
FIG. 5 is a side view of the forward portion of the transformer box of FIG. 2 showing the hinged cover arrangement.
Figures 2, 3, 4, 6, 7:
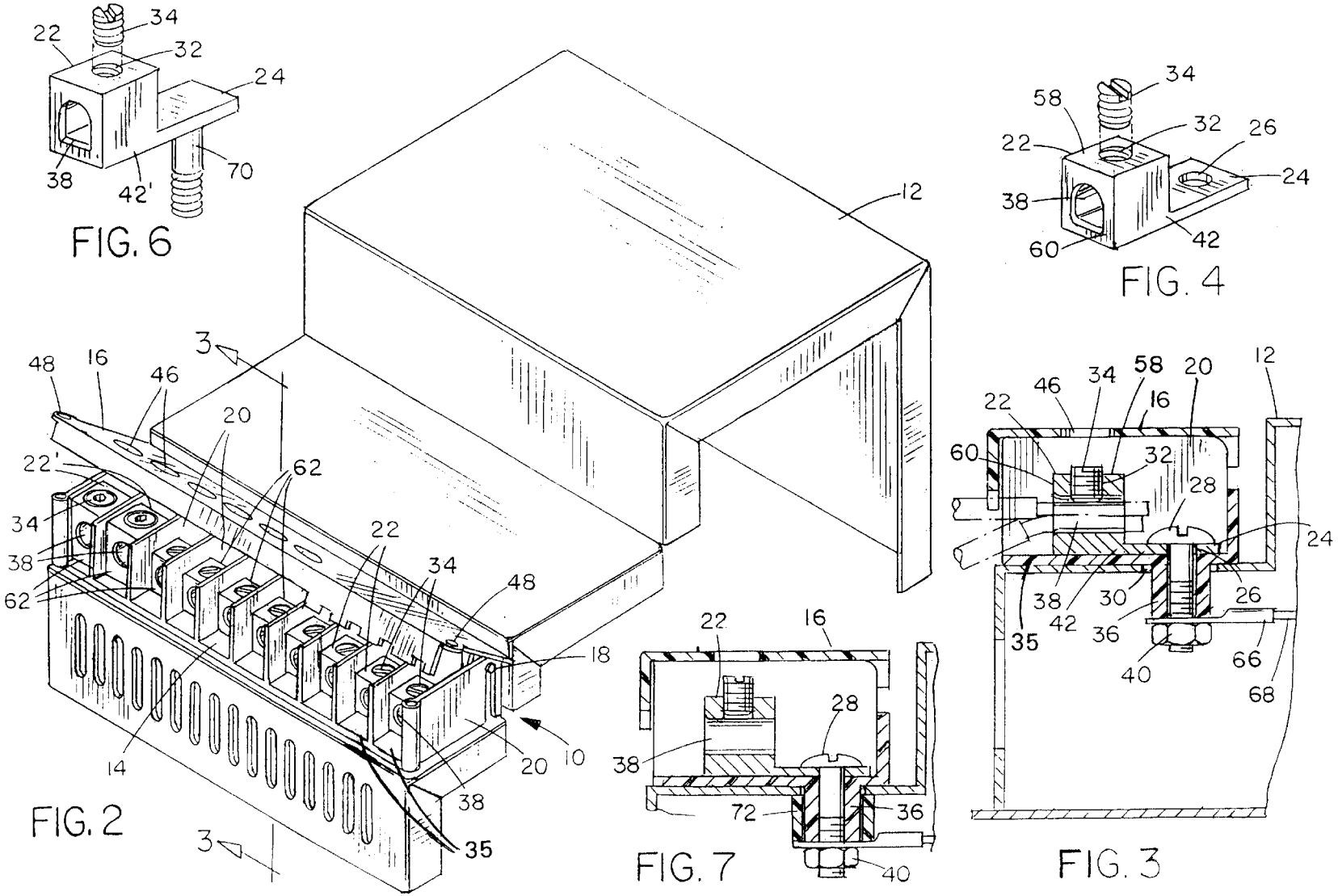
FIG. 2 is a perspective view of the transformer box connector.
FIG. 3 is an enlarged sectional view taken on line 3—3 of FIG. 2.
FIG. 4 is a perspective view of a single terminal block.
FIG. 6 is a perspective view of an alternative embodiment of the terminal block.
FIG. 7 is an enlarged sectional view taken along line 3—3 of FIG. 2 showing the clamping sleeve.

Referring to FIGS. 2 and 5, the transformer box connector 10 comprises a terminal block retainer 14 mounted on a housing 12 located in the interior of the transformer box 50. The terminal block retainer 14 has a hinged cover 16 that is secured by an axial joint 18 located in the rear corners of the terminal block retainer 14. The hinged cover can be lifted and slide downward from the top of the rear corners so that the hinged cover 16 will be locked into place. The hinged cover 16 will preferably have slots or holes 46 in the top, which may be circular or any another shape sufficient to allow a screwdriver or fastening device easy access to tighten the setscrew 34 without lifting the hinged cover 16, thereby preventing direct contact with the wire or connector. The hinged cover 16 can include a plurality of slots or openings 48 in the front corners or sides to allow fastening screws to prevent movement of the hinged cover 16 for additional safety measures.

Generally, during installation, hinged cover 16 will be lifted or completely removed, allowing the installer ready access to all terminal blocks 22 to ensure secure connections. After installation, the installer will close and attach the hinged cover 16 to restrict access to the terminal blocks 22 and, thus, live connections. As shown, holes 46 in hinged cover 16 overlie only the stepped-down voltage connections 62, preventing access entirely to the higher input voltage and, thus, eliminating the most significant safety hazard.

The terminal block retainer 14 has a plurality of insulating partitions or ribs 20 which extend upward from a base portion 35. The ribs 20 are spaced apart so that each space between a pair of ribs is adapted to receive a single terminal block 22 so as to permit insertion of electrical wires from a direction that is generally parallel to the direction of the ribs. The ribs 20 are preferably higher than the terminal blocks 22 so that each terminal block is fully recessed within its corresponding space. The ribs 20 provide insulation between adjacent terminal blocks and protect the user from inadvertent contact with one terminal block when working on a neighboring terminal block 22.

Terminal block 22 will preferably be formed of a die cast aluminum or other electrically conductive material. Alternative methods of manufacturing the terminal block will be readily apparent to those of skill in the art, and may include machining or molding.

Referring to FIGS. 3 and 4, the body of each terminal block 22 has a front face 60 and a top 58, which have bores 38 and 32 respectively, formed therethrough which intersect within the block. The front face bore 38 can be formed as a circle, but is preferably off-circular, with an inverted U-shape, to provide a larger opening near the bottom of the block to facilitate insertion of larger gauge wires. Bore 38 extends horizontally through the body of the block, exiting from the rear face, allowing the user to readily visually confirm complete insertion and proper contact for all wires to be connected in the terminal block. The large opening, relative to conventional connectors, permits several multi-wire electrical cables to be securely inserted without risk of missing or bending a few wires because the bundle fits so tightly within the connector sleeve. Failure to secure all wires of a cable within a connection can be a significant problem in outdoor lighting systems since it can lead to arcing and overheating at the connection. The terminal block of the present invention eliminates this risk.

Top bore 32 is threaded, preferably from the top to the bottom of the interior of the block, for receiving a setscrew 34 for locking wires in place after insertion into the front face bore 38. The preferred top-to-bottom threading of the top bore 32 provides the widest possible range of travel of setscrew 34 so that a single terminal block can securely attach from one small gauge wire to several larger gauge cables, providing a significant increase in the capacity of the terminal connection as compared to conventional connectors.

Each terminal block 22 is mounted to the terminal block retainer 14 by way of a planar member 24 that extends horizontally from the base of the generally cube-shaped terminal block body. A fastening member attaches to the planar member 24. The fastening member can be configured as a fastening screw 28 or a fastening post 70 as shown in FIGS. 4 and 6, respectively. In the embodiment of FIG. 4, the planar member 24 has an opening 26 at its center for receiving a fastening screw 28. The fastening screw 28 is inserted at the opening 26 of the planar member 24 passing through the circular shaft 36 of the terminal block retainer, through the housing opening 30, and secured at its end by a receiving nut 40. In the embodiment of FIG. 6, the planar member 24 is solid with an integrally-formed fastening post 70 extending from the underside of the planar member 24. The fastening post 70 is threaded at least at its lower end for attachment of receiving nut 40 once the terminal block is placed on terminal block retainer 14.

The fastening member, i.e., fastening screw 28 or fastening post 70, provides electrical conduction between the terminal block 22 and the transformer. An electrical wire 68 from a transformer tap is attached to the fastening member by a round washer crimp 66 or a similar fastening means. The round washer crimp 66 attaches to the electrical wire 68 allowing for insertion onto the fastening member. The washer portion of the round washer crimp 66 is slid onto the end of fastening member and upward, until the top portion is butted against the circular shaft 36 of the terminal block retainer 14. The round washer crimp 66 is secured in place by the receiving nut 40 so that the round washer crimp 66, and, thus electrical wire 68 is secured between the circular shaft 36 and the receiving nut 40.

Referring to FIG. 7, a plurality of retaining sleeves 72 can be used to secure the housing 12 against the terminal block retainer 14 by providing uniform pressure between the upper face of the housing 12 and the terminal block retainer 14. The retaining sleeves 72 are inserted over the fastening member 28 or 70 and mount on the circular shaft 36 of the terminal block retainer 14. The receiving nut 40 provides for securing the retaining sleeves 72 in place. Generally, only two retaining sleeves 72 will be needed, with the sleeves placed on either side of a centerline that bisects the terminal block retainer 14. However, additional retaining sleeves 72 may be used.

The transformer box connector of the present invention provides many advantages over devices currently available for use in lighting systems. Among these advantages, it allows for secure and protected insertion of electrical wires having a wide range of thickness, while still being compact and simple-to-use. The open construction of the terminal block allows the user to visually confirm secure connection. The hinged cover provides ready access during installation, but thereafter protects against accidental contact with a bare wire or an exposed connector, thereby helping to limit the possibility of severe injury from electrical shock.

It will be apparent to those skilled in the art that various modifications and variations may be made in the apparatus and process of the present invention without departing from the spirit or scope of the invention. Thus, it is intended that the present invention cover the modification and variations of this invention provided they come within the scope of the appended claims and their equivalents.

I claim:

1. An electrical terminal connector for mounting in a transformer box for connecting an external wire to a transformer within the transformer box, comprising:

(a) a body comprising a conductive material having a cubic shape comprising a front face, a rear face, two sides, a top and a base with a first bore extending horizontally therethrough from the front face to the rear face, wherein the first bore has an inverted U-shape so that the first bore is larger near the base, and a second bore extending vertically from the top, wherein the first and second bores intersect within the body, the second bore having a thread formed therein, and wherein the two sides are continuous with no openings therethrough;

(b) a set screw for mating with the second bore for trapping the wire inserted through the front face into the first bore; and (c) the base further comprising a base extension extending from the cubic shape comprising means for extending a fastener for conductively attaching the body to an internal wire connected to the transformer, wherein the fastener further comprises means for fastening the body to a non-conductive surface within the transformer housing.

2. The electrical terminal connector as in claim 1, wherein the base extension comprises a planar member extending from the body.

3. The electrical terminal connector as in claim 1, wherein the body and the base are die-cast aluminum.

4. The electrical terminal connector as in claim 1, wherein the base extension further comprises a conductive connector extending from a bottom side of the base, wherein the conductive connector passes through an opening formed in the non-conductive surface and comprises the fastening means.

5. The electrical terminal connector as in claim 4, wherein the conductive connector is a screw and further comprising a nut for securing the internal wire to the screw.

6. The electrical terminal connector as in claim 5, further comprising a retaining sleeve disposed around the screw between the nut and the base extension.

7. The electrical terminal connector as in claim 4, further comprising a fastening post extending from a lower surface of the base extension for electrical connection to the internal wire.

8. The electrical terminal box connector as in claim 7, wherein the fastening post is threaded for receiving a nut for securing the internal wire to the fastening post.

9. The electrical terminal box connector as in claim 8, further comprising a retaining sleeve disposed around the fastening post between the nut and the base extension.

10. The electrical terminal box connector as in claim 7, wherein the body and base extension of the terminal block are integrally formed with the fastening post.

11. An electrical terminal connector for mounting in a transformer box for connecting a plurality of external wires to a transformer within the transformer box, comprising:

(a) a terminal block retainer comprising a base portion, a plurality of ribs extending from the base portion, and a hinged cover for covering the plurality of ribs, wherein the terminal block retainer comprises an insulating material and each pair of ribs of the plurality and the base portion therebetween defines a space so that a plurality of spaces are defined, and wherein the hinged cover has a plurality of access openings therethrough corresponding to at least a portion of the spaces; and (b) a plurality of individual terminal blocks mounted within the terminal block retainer, wherein one terminal block is disposed within each space so that all surfaces of the terminal block are recessed within the space, each terminal block for receiving at least one electrical wire, wherein each terminal block comprises:

(i) a conductive body having a cubic shape comprising a front face, a rear face, two sides, a top and a base with a first bore extending horizontally therethrough from the front face to the rear face, wherein the first bore has an inverted U-shape so that the first bore is larger near the base, and a second bore extending vertically from the top, wherein the first and second bores intersect within the body, the second bore having a thread formed therein, and wherein the two sides are continuous with no openings therethrough;

(ii) a set screw for mating with the second bore for trapping the wire inserted through the front face into the first bore; and (iii) the base further comprising a base extension extending from the cubic shape comprising means for extending a fastener for conductively attaching the body to an internal wire connected to the transformer, wherein the fastener also comprises means for fastening the body to the terminal block retainer.

12. An electrical terminal connector as in claim 11, wherein each of a first group of terminal blocks of the plurality of terminal blocks comprises a connection to a stepped-down voltage and a each of a second group of terminal blocks of the plurality of terminal blocks comprises a connection to an input voltage, and wherein the plurality of access openings in the hinged cover provide access to the set screw for only the first group of terminal blocks, so that access to the second group of terminal block is prevented when the hinged cover is closed.

13. An electrical terminal connector as in claim 11, wherein the base extension of the terminal block comprises a planar member extending from the body.

14. An electrical terminal connector as in claim 13, wherein the planar member further comprises a conductive connector extending from a bottom side of the base extension, wherein the conductive connector passes through an opening formed in the base portion of the terminal block retainer and comprises the fastening means.

15. The electrical terminal connector as in claim 14, wherein the conductive connector is a screw and further comprising a nut for securing the internal wire to the screw.

16. The electrical terminal connector as in claim 14, further comprising a retaining sleeve disposed around the screw between the nut and the base portion of the terminal block retainer.

17. The electrical terminal connector as in claim 13, further comprising a fastening post extending from a lower surface of the planar member for electrical connection to the internal wire.

18. The electrical terminal connector as in claim 17, wherein the fastening post is threaded for receiving a nut for securing the internal wire to the fastening post.

19. The electrical terminal connector as in claim 18, further comprising a retaining sleeve disposed around the fastening post between the nut and the base portion of the terminal block retainer.

20. The electrical terminal connector as in claim 17, wherein the body and base extension of the terminal block are integrally formed with the fastening post.

21. The electrical terminal connector as in claim 11, wherein the body and the base extension are die-cast aluminum.

22. The electrical terminal connector as in claim 11, further comprising at least one fastener opening in the hinged cover for receiving a fastener to prevent opening of the hinged cover.

23. The electrical terminal connector as in claim 11, wherein the terminal block retainer is mounted on a housing enclosing the transformer.

* * * * *